United States Patent [19]

Reiff

[11] Patent Number: 4,520,933

[45] Date of Patent: Jun. 4, 1985

[54] DEVICE FOR STACKING CUT PLATES IN PLATE SHEARS

[75] Inventor: Harro Reiff, Leipheim, Fed. Rep. of Germany

[73] Assignee: Karl Mengele & Söhne, Günzburg, Fed. Rep. of Germany

[21] Appl. No.: 366,143

[22] Filed: Apr. 7, 1982

[30] Foreign Application Priority Data

Apr. 11, 1981 [DE] Fed. Rep. of Germany ..... 3114718

[51] Int. Cl.[3] ..... B07C 5/36

[52] U.S. Cl. ..... 209/606; 198/480; 209/706; 209/707

[58] Field of Search ..... 209/552, 559, 586, 687, 209/686, 689, 690, 707, 916, 919, 922, 942, 925, 933, 606, 706; 198/456, 480, 482, 801, 367; 271/178, 187, 315; 414/51, 81; 83/27, 89, 94

[56] References Cited

U.S. PATENT DOCUMENTS

| | | | |
|---|---|---|---|
| 1,006,902 | 10/1911 | Bickerton | 198/480 |
| 3,389,791 | 6/1968 | Naslund | 209/686 |
| 3,791,518 | 2/1974 | Vanderhoof | 209/552 |
| 3,795,301 | 3/1974 | Sugitani | 198/690 |

FOREIGN PATENT DOCUMENTS

| | | | |
|---|---|---|---|
| 254020 | 5/1963 | Australia | 209/933 |

*Primary Examiner*—Robert B. Reeves
*Assistant Examiner*—Donald T. Hajec
*Attorney, Agent, or Firm*—Toren, McGeady, Stanger Goldberg & Kiel

[57] ABSTRACT

A device for stacking plates or sheet metal blanks cut in guillotine shears includes a rotatable drum with radially outwardly extending partitions defining a number of compartments located around the circumferential outside surface of the drum and extending in the axial direction of the drum. Each compartment receives a cut plate in a first position, carries the plate to a second position where the plate is moved by a displacement device in the axial direction of the drum into a location corresponding to a stacking position, and then with further rotation of the drum, the compartment reaches a third position where the plate is removed to the stacking position. Further, conveyor belts can be used to receive plates from the compartments in the drum and to carry the plates to stacking positions spaced from the drum.

8 Claims, 4 Drawing Figures

Fig. 3
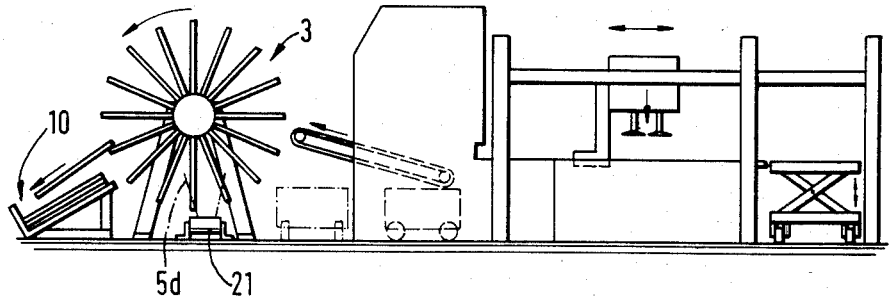
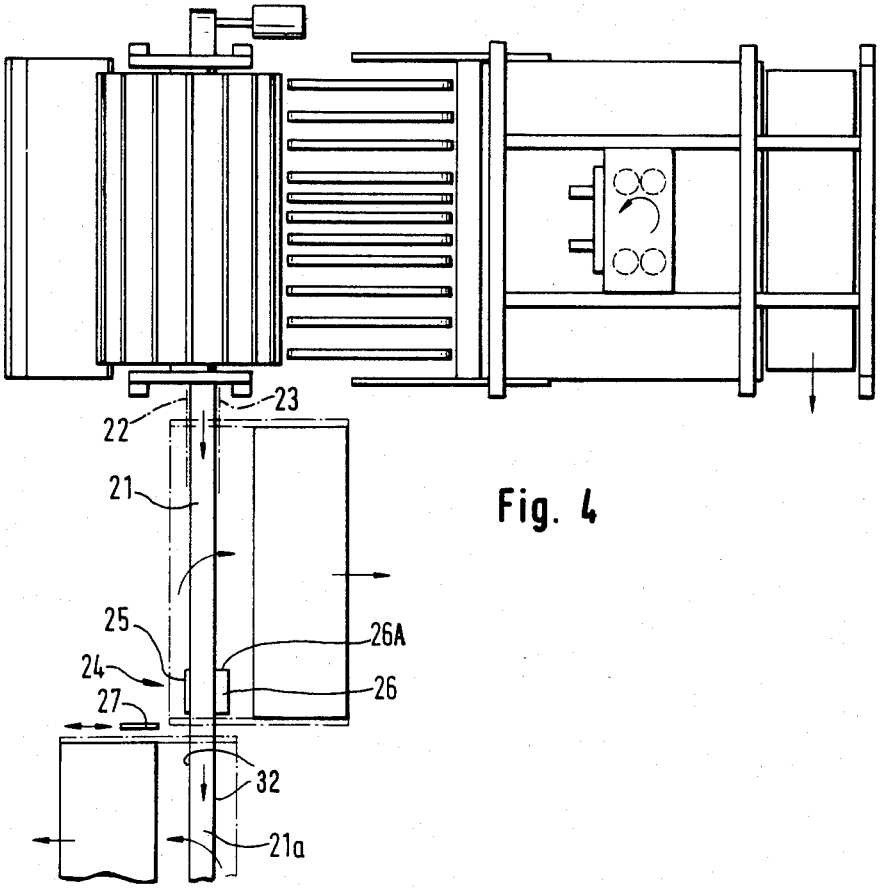
Fig. 4

DEVICE FOR STACKING CUT PLATES IN PLATE SHEARS

BACKGROUND OF THE INVENTION

The invention concerns a device for the automatic stacking of plates or sheet metal blanks cut in a guillotine shears.

Devices of this type collect the cut plates for subsequent transportion or use. Such devices, however, are only suitable for cut plates of a uniform shape, that is, for plate strips of the same size. For plates of different geometrical form, as obtained particularly in the rational streamlined cutting of sheet metal plates, the sorting and grading of the cut plates is time-consuming and is frequently complicated by a lack of space.

SUMMARY OF THE INVENTION

Accordingly the object of the invention is to provide a device for the automatic sorting and stacking of cut plates or sheet metal blanks.

In accordance with the present invention two embodiments of a feeding and stacking device are provided, which can be adapted to the various operating conditions and can also be used in combination.

Both embodiments provide a drum rotating in a frame and driven by a stepping switchgear or a hydraulic servo-drive system. The drum is subdivided by radial partitions into chambers or compartments, and the compartments can be moved into a certain position along one side of the drum to serve as a receiving compartment for the cut plates.

In one embodiment, a displacement device is provided in the upper region of the drum for sorting the cut plates located in the compartments into specific positions aligned with the drum axis along the length of the compartments. The means for effecting displacement of the cut plates are disposed out of engagement during the rotational movement of the drum. Each compartment forms an output compartment on the side of the drum opposite the receiving compartment, and the output compartment opens onto stacking positions distributed over the length of the drum. Stops are provided in the compartments limiting the ejection of the cut plates to the stacking positions.

In this device the sorting of the plates is achieved in the immediate vicinity of the plate shears. The cut plates can be moved from the stacking positions by the usual conveyer means to a further processing station.

The second embodiment of the invention provides a belt conveyer at a small distance underneath the drum so that the cut plates received in a compartment acting as a receiving compartment move to the positions where the compartment acts as an output compartment where the plates are lowered onto the belt conveyer, that is, by unlocking the stop of a pivotal retaining claw or controllable ejectors in the compartment. Guide boards are located laterally of the belt conveyer below the output compartments and hold the cut plates in the upright position as the plates move from the output compartment onto the belt conveyer, if necessary with the cooperation of sorting gates or switches and turntable-conveyer parts or the like with branched conveyer belts or overhead conveyers. The belt conveyer carries the plates to a stacking location and includes a stacking table extending the guide board on one side of the belt conveyer. On the other side of the belt conveyer a sliding stop plate extends the guide board, whereby the cut plate or plates can be stopped at the location of a respective stacking device by the stop plate displaceable in or pivoting in the belt conveyer path.

The control of the drum and stacking devices can be effected manually by the operator performing the separating and grading operations by a selector in the sequence control of the drive.

The size and shape of the cut plates or blanks discharged from the drum can also be measured electronically on the conveyer belt and directed to various stacking devices.

Furthermore, the control can be designed so that the cutting and working sequence of the plate shears is provided by an external data source to a process computer which uses the data to record the order of the inputs to the receiving compartment and transmits the corresponding stack positions to a microprocessor which controls the displacement device and stacking device.

Other embodiments of the device according to the invention are described in the claims.

The invention is illustrated in the drawing and will be described more fully on the basis of embodiments.

BRIEF DESCRIPTION OF THE DRAWING

FIG. 3 shows a diagrammatic view of a stacking and sorting device with a conveyer device; and FIG. 4 shows a top view of a device illustrated in FIG. 3.

DESCRIPTION OF THE PREFERRED EMBODIMENTS

Figure 1:
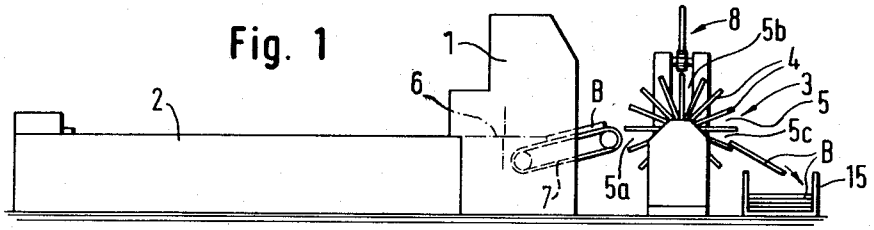
FIG. 1 shows a stacking and sorting device according to the invention in a side elevational view.

In the drawing, plate shearing machine 1 receives sheet metal strips or plates from a plate feeding table 2, and a drum 3 according to the invention, receives the cut plates from the shearing machine. The drum 3 is subdivided by radially extending partitions 4 into compartments 5 extending along the drum 3. As the drum 3 rotates the compartments 5 assume different functions. As shown in FIG. 1, compartment 5*a* is a receiving compartment receiving cut plates B from a conveyer belt 7 running between the shear table 6 and the drum 3.

Figure 2:
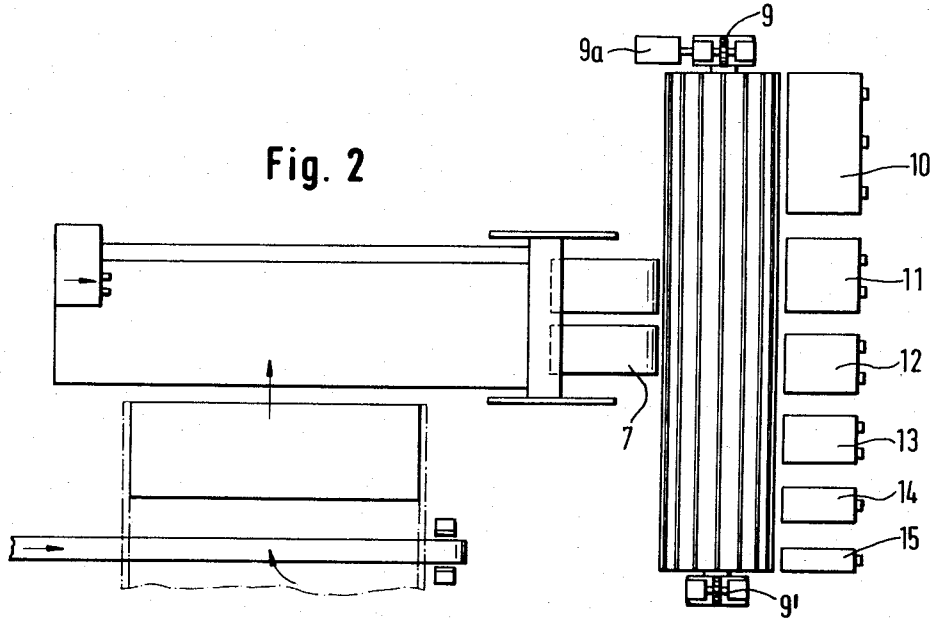
FIG. 2 shows the stacking and sorting device according to FIG. 1 in a top view.

In the embodiment according to FIGS. 1 and 2, the cut plates B arrive successively in the compartments 5 in the drum at the compartment position 5*b* where a displacement device 8 is arranged at the vertex or crown of drum 3. This displacement device consists of carrier rakes or cradles, not shown, guided on chains traveling over chain wheels 9 and 9' and the rakes or cradles engage longitudinal grooves, likewise not shown, in the compartment partitions 4 and move the sheet metal plates inside the compartments 5 into one of the stacking positions 10 to 15. The carrier rakes or cradles are pulled out of the compartment partitions 4 during drum movement. In other words, each compartment is stopped, in turn, at the position 5*b* and the displacement device 8 locates the plate in the compartment at a stacking position. From the compartment position 5*b*, the rotation of the drum moves the compartments, with the plate in a stacking position, to compartment position 5*c*. The cut plates B are fed to the stacking positions from the compartment position 5*c*. Naturally the compartments to the right and left of the vertex or crown can also be used for the stepwise positioning or manipulation of the cut plates B into the stacking positions.

A servodrive system, not shown, moves the drum 3 in synchronization with the movement of the plates into the compartments 5. The valves of the servodrive system and of the displacement device 8 are controlled by a microprocessor whose computer also records the order of the plates cut by the plate shears.

FIGS. 3 and 4 shows a diagrammatic view of a modified stacking and sorting device with a device for moving a part of the cut plates to remote stacking and processing locations. In addition to the above-mentioned sorting facilities at the stacking positions 10–15, a conveyer belt 21 is arranged below the drum 3 along the stacking positions 10–15. As shown in FIG. 4, guide boards 22 and 23 are located laterally along the conveyer belt 21 and extend outwardly from the end face of drum 3. The guide boards are interrupted at stacking or belt conveyer sections or terminate at branches of conveyer belt 21 which can be adjusted by switches or sorting gates.

Stacking device 24, according to the invention, consists of a sliding plate 25 forming a continuation of the guide board 22 located along one side of the conveyer belt 21, and of a stacking table 26 with a bottom 26A forming a continuation of the other side. A stop 27 movable in the direction of the arrows shown in FIG. 4 can retain the cut plates B on the stacking device 24.

The cut plates B retained by stop 27 are pushed onto a support surface 26*a* of stacking table 26 by the sliding plate 25 provide with a drive, not shown. The stacking table 26 stores the cut plates. Several stacking locations can be provided along the path 21*a* of the conveyer belt 21, preferably at individual machines processing the cut plates or at their stacking locations.

Guide boards 32 are provided along path 21*a*.

I claim:

1. Device for stacking plate-like members, such as sheet metal blanks, cut by a guillotine shears, comprising a drum having an axis and being rotatable about the axis, said drum having a circumferentially extending outside surface, a plurality of partitions extending radially outwardly from the outside surface of said drum and each pair of said partitions forming therebetween a compartment closed radially inwardly by the outside surface of the drum and being open radially outwardly, each of said compartments being movable with said drum into a first position for receiving a plate-like member, into a second position spaced angularly from the first position and into a third position spaced angularly from the second position and located opposite the first position with the third position arranged for removing the plate-like member from said compartment, a displacement device located at the second position and being movable in the axial direction of said drum for selectively positioning the plate-like member within the compartment in the axial direction of said drum so that in the third position the plate-like member can be removed to a selected stacking position, and said displacement device being positionable out of the path of said partition when said drum is rotated.

2. Device, as set forth in claim 1, means forming the stacking position for receiving selected plates from the third position of said compartments and said means including stops for the plate-like members.

3. Device, as set forth in claim 1, wherein each said compartment being movable to a fourth position spaced angularly from the third position with the fourth position being located generally opposite the second position, a belt conveyer located below the drum aligned below the fourth position.

4. Device, as set forth in claim 1, including a belt conveyer positionable below said drum and extending in the axial direction of said drum outwardly therefrom, and guide boards extending along the sides of said belt conveyer for supporting plate-like members positioned on said belt conveyer.

5. Device, as set forth in claim 4, wherein at least one stacking table is located adjacent said conveyer at a position spaced outwardly from said drum, said guide boards extending from said drum to said stacking table, and a thrust plate located on one side of said belt conveyer and forming a continuation of one of said guide boards and arranged to displace plates on said belt conveyer onto said stacking table.

6. Device, as set forth in claim 5, including stop means positionable in the path of said belt conveyer outwardly from said drum for interrupting the path of movement of the plate-like members on said belt conveyer.

7. Device, as set forth in claim 1, including a shears table located on the side of said drum where the first position of said compartments is located, and said first position of said compartments located approximately at the same height as said shears table.

8. Device, as set forth in claim 1, including a shears table located on the same side of said drum as the first position of said compartments, an inclined conveyer belt extending from said shears table to said drum with said conveyer belt inclined upwardly from said shears table to the first position of said compartments.

* * * * *